United States Patent [19]

Beckers

[11] 4,150,176

[45] Apr. 17, 1979

[54] METHOD AND DEVICE FOR PRODUCTION OF REFRACTORY LINING OF A TUBULAR VESSEL

[75] Inventor: Karl D. Beckers, Cologne-Lindenthal, Fed. Rep. of Germany

[73] Assignee: Martin & Pagenstecher GmbH, Cologne, Fed. Rep. of Germany

[21] Appl. No.: 660,282

[22] Filed: Feb. 23, 1976

[30] Foreign Application Priority Data

Feb. 26, 1975 [DE] Fed. Rep. of Germany ..... 2508239

[51] Int. Cl.[2] ..... B05D 7/22; C21C 5/44; F27D 1/16

[52] U.S. Cl. ..... 427/233; 266/281; 264/30; 264/270; 264/269; 264/309; 264/310; 427/236

[58] Field of Search ..... 118/306, 317, 318, DIG. 10; 266/281; 264/267, 269, 270, 301, 309, 310, 311, 30; 427/231, 233, 236

[56] References Cited

U.S. PATENT DOCUMENTS

| | | | |
|---|---|---|---|
| 2,185,570 | 1/1940 | Ridley | 118/306 |
| 3,799,445 | 3/1974 | Marino | 118/317 |
| 3,827,633 | 8/1974 | Kouro | 118/306 |
| 3,836,612 | 9/1974 | Mann | 264/310 |
| 3,872,912 | 3/1975 | Axmann | 264/30 |

FOREIGN PATENT DOCUMENTS

| | | | |
|---|---|---|---|
| 283916 | 1/1966 | Australia | 427/231 |
| 2416977 | 10/1975 | Fed. Rep. of Germany | 266/281 |
| 1426135 | 2/1976 | United Kingdom | 266/281 |

*Primary Examiner*—Sam Silverberg

*Attorney, Agent, or Firm*—Sprung, Felfe, Horn, Lynch & Kramer

[57] ABSTRACT

A process for the production of a refractory lining within a tubular vessel which comprises disposing said tubular vessel so that the longitudinal axis running therethrough is horizontal, slinging a moist refractory mass onto a longitudinal or annular section of the interior wall of the tubular vessel and thereafter applying moist refractory mass to additional longitudinal or annular sections as the case may be. The process can be conducted either by rotating the vessel so as to expose successive annular sections and applying refractory mass to said sections from a fixed position or it can be performed by moving the source of refractory mass longitudinally to cover longitudinal sections and rotating the vessel only partially so as to bring the stream of refractory mass against a second longitudinal section. Devices to carry out these processes are disclosed including a slinger machine disposed for longitudinal movement within the vessel and means for rotating the vessel to the desired extent. Reciprocatingly movable supply means for supplying refractory mass to the slinger machine are also provided.

26 Claims, 2 Drawing Figures

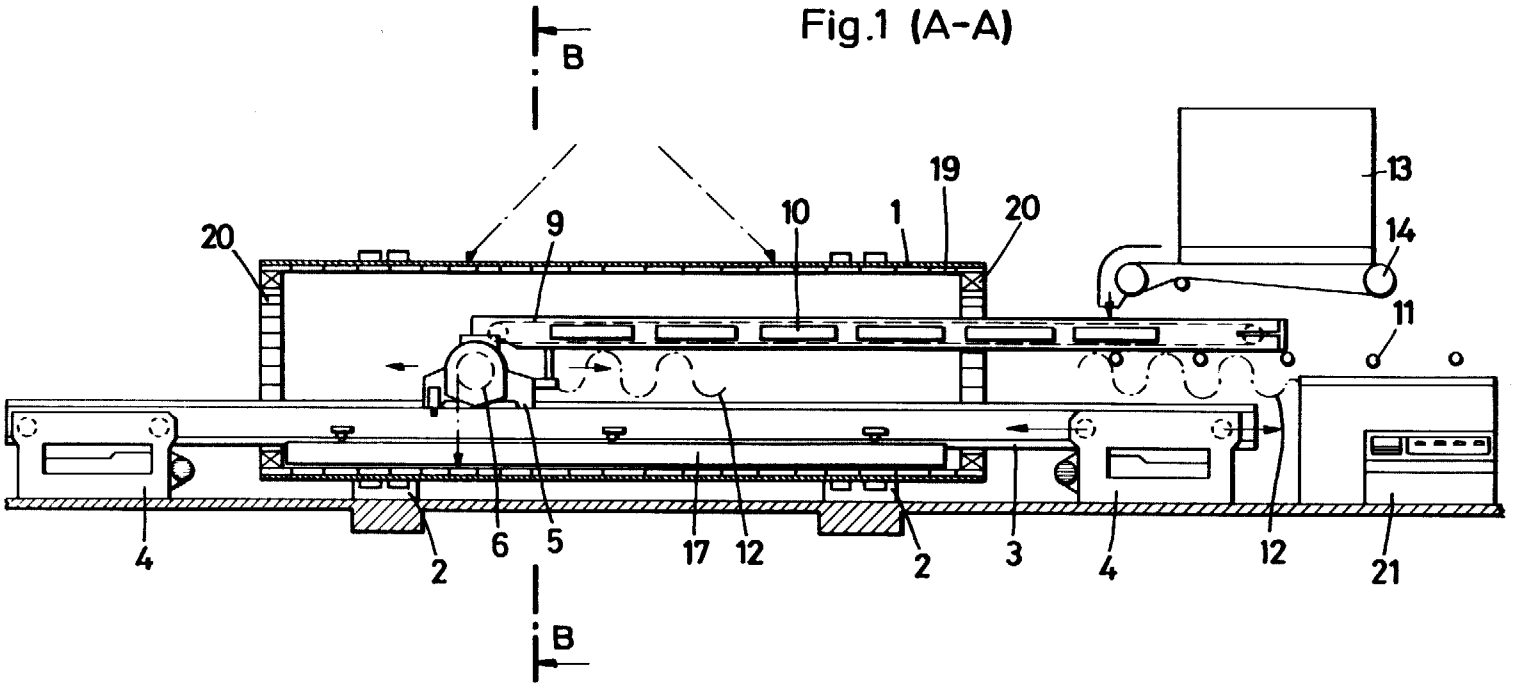
Fig.1 (A-A)

Fig.2(B-B)
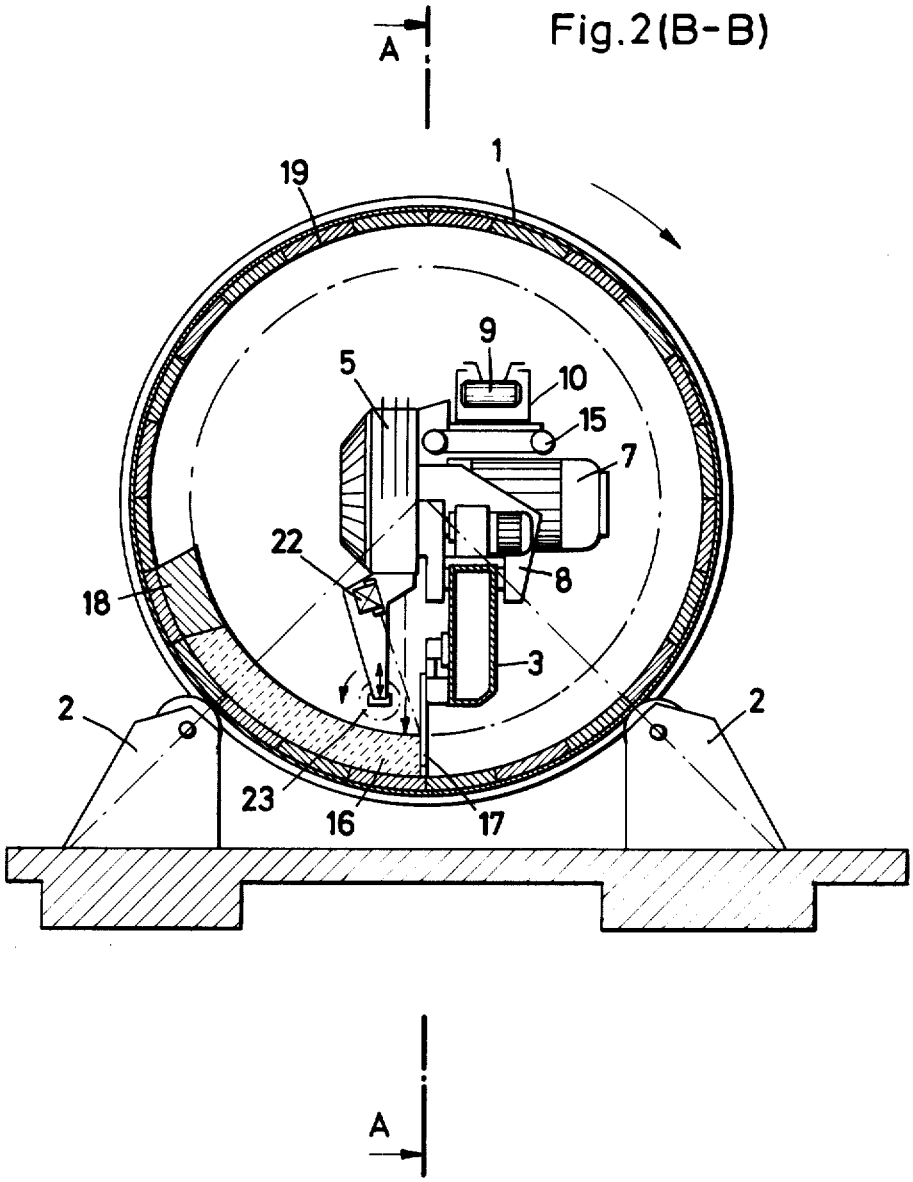

METHOD AND DEVICE FOR PRODUCTION OF REFRACTORY LINING OF A TUBULAR VESSEL

BACKGROUND OF THE INVENTION

Field of the Invention

This invention relates to the production of a refractory lining within a rotatable tubular vessel. More especially this invention relates to processes and apparatus for disposing a refractory lining on a horizontally disposed tubular rotatable vessel, particularly of the type employed in metal refining processes. This invention is particularly concerned with the production of a refractory liner within a tubular vessel which is provided with detachable locking covers on both sides thereof. The invention is particularly concerned with a method and device for the production of a refractory liner of a tubular rotatable vessel of the type employed in the transportation of pig iron.

DISCUSSION OF THE PRIOR ART

Torpedo ladles in which the vessel of a refractory lining consists of a cylindrical middle part and two conical end portions have been used predominantly as movable transport means for pig iron. The end parts are locked with a secure cover which has a fixed pivot for positioning and rotating the vessel. Since such a vessel has only one inlet and outlet opening in the cylindrical middle portion, mechanization of the delivery of the refractory lining or of the breaking off of the spent lining can only be effected in a restrictive manner, if at all. The operations for delivery in breaking off of the respective linings must be carried out with a great deal of manual effort under most unfavorable conditions.

It has already been heretofore proposed to develop the vessel of a transport ladle for pig iron in the form of a cylinder having detachable locking covers on each side. It is further possible, by positioning the vessel differently, to detach the vessel from both wheel frames and to place it on an operating device which effects the rotation of the vessel, if necessary.

The spent refractory lining can be broken off and cleared out substantially by mechanical means after the detachable locking covers have been removed. Delivery of the new lining is also simplified by the changed shape of the transport ladle. This simplification, however, relates essentially to the conveying of the refractory materials to the brick lining points, while the brick lining itself must be carried out for the most part by manual means. Obviously the brick lining of the interior of the vessel requires a considerable period of time owing to the fact that the bricks must be disposed therein manually.

It is an object of this invention, therefore, to provide a fully mechanized method for the disposition of a refractory lining within a tubular rotatable vessel such as the type provided with detachable locking covers on the respective ends.

It is another object of the invention to provide a device by which a lining can be completely mechanically disposed within the interior of a tubular rotatable vessel which device does not require manual assistance.

SUMMARY OF THE INVENTION

The objects of this invention are provided, in general, by a process which comprises disposing the tubular rotatable vessel so that the longitudinal axis running thereto is horizontal, slinging a moist refractory mass onto a section of an interior wall thereof and, applying moist refractory mass to a second section on the interior wall of said tubular vessel. After the moist refractory mass has been applied to the various sections it is dried to form a refractory liner.

The present invention has several different embodiments. In one embodiment the moist refractory mass is applied to a single longitudinal section of the interior wall of the vessel. Thereafter, the vessel is rotated and moist refractory mass is applied from the same source to a successive londigutinal section. These successive steps are repeated until the entire interior circumference of the tubular vessel are coated with refractory material. The refractory material is dried after all of the refractory material has been applied simply by the use of high temperatures, as known in the art.

It is also possible to carry out the invention by disposing the refractory mass upon a longitudinal section and thereafter moving the mass to a second longitudinal section whereby to expose the first longitudinal section so that it can once again covered with refractory material. This can be conducted until the entire circumference of the interior of the tubular vessel is covered with refractory material.

Therefore, the solutions to the problems thus far faced in inserting new refractory liners into the vessels involves slinging a moist refractory mass onto the interior wall of the tubular vessel. This can be accomplished by the use of a slinger machine positioned normal to the interior wall of the vessel when the vessel is in its horizontal position. The produced mass stream is directed parallel to the axis of the vessel over the length of the vessel and the vessel, according to one embodiment, is rotated in stages. In so doing, the direction of the mass stream parallel to the axis of the vessel can be achieved on moving the slinger machine backwards and forwards. Thus according to one embodiment of the invention the slinger machine is positioned on a bearer such as a box beam disposed within the vessel. The slinger machine is rideable over this bearer so that it can reciprocatingly move backwards and forwards as it applies the moist refractory mass to the longitudinal section to be covered. When the entire longitudinal section has been covered with refractory mass, i.e., when its entire length and width have been covered, then the vessel is rotated about its horizontal axis to face an uncovered second longitudinal section of the vessel adjacent the slinger machine.

The slinger machine is thence operated once again to dispose moist refractory mass onto this section. The successive steps of applying the refractory mass and rotating the vessel or moving the slinger machine are conducted until substantially the entire interior of the vessel is coated with refractory mass. Thereafter, the mass is dried in the usual manner.

Thus, according to a further development of the invention, a longitudinal section of the refractory lining is slung in its complete thickness and the next longitudinal section of the refractory lining is slung after rotating the vessel about the width of the first longitudinal section. It is a further advantage of the invention if the mass slung onto the interior wall of the vessel is supported on the free side of the section of the lining by a vertical template.

In addition, in order to sling the first longitudinal section of the refractory lining, the second free side is desirably supported by a brick longitudinal stone layer, as would be explained below.

An alternative method of the invention consits in slinging a highly refractory moist mass onto the wall by a slinger machine normally disposed to the inner wall of the vessel when the vessel is in the horizontal position. The mass stream is held by rotating the vessel in its position and after finishing the first annular section the slinger machine is moved longitudinally so that another annular section can be produced.

It is of advantage in this alternative if the annular section of the refractory lining is slung in its complete thickness and after shifting the mass stream around the width of an annular section the next annular section of the refractory lining is slung with refractory material.

A device particularly suited for carrying out the above described invention is one which comprises a bearer passing through the vessel generally parallel to the longitudinal axis, said bearer carrying a slinger machine rideable on said bearer in the longitudinal direction. Means are provided for feeding a refractory mass to the slinger machine and means are provided for moving the slinger machine longitudinally while on said bearer. Generally speaking, the bearer is arranged concentrically inside the vessel and is positioned outside the vessel on both sides thereof so as to support and direct the slinger machine which moves backwards and forwards along the length of the bearer.

The bearer is preferably formed as a rectangular box beam arranged edge-wise, whereas the slinger machine has a wheel track with a drive motor which embraces the upper section of the box beam in the form of a "U" for the support and direction thereof and to which a slinger wheel casing with a slinger wheel and a slinger wheel drive motor are secured.

A preferred embodiment of the apparatus lies in the provision for means for feeding the refractory mass to the slinger machine. Generally, this means comprises a conveyor belt which can be arranged in an elongated supporting structure which is tightly connected to the slinger machine on one end and on the other end is positioned so that it can reciprocatingly move backwards and forwards on a roller track.

There is disposed on the slinger machine or adjacent thereto such as on the bearer a milling machine to insure that the interior surface of the refractory mass is smooth. The milling machine can, therefore, be employed within the tubular vessel in juxtaposition to the slinger machine to smooth the surface of the slung lining.

With respect to the slinger machine slinger machines of known construction can be employed. The use of slinger machines for the coating of steel or pig iron ladles is already known. However, these slinger machines have been employed while the ladles have been positioned vertically and thus they have been employed in the free space between the wall of the ladle and a template. In such instance the refractory mass is introduced and compressed. The mass stream issuing from the slinger stream is thereby conducted without reversal into a closed and confined region. The use of slinger machines is shown in German Pat. Nos. 1,235,522, and 2,004,429. It is also shown in British Pat. No. 1,326,097. The contents of such patents is hereby incorporated herein by reference. In the known processes there is involved the slinging of the mass at an acute angle to the ladle wall employing a vertically positioned ladle. There is formed annular layers in horizontal or vertical sequence by rotating the pan. See German Offenlegungsschrift No. 1,483,584.

In contrast to the prior art advantages are realized according to the present invention in that the vessel is lying in horizontal position and the refractory mass is slung normally to the inner wall of the vessel. There results a uniform construction of the lining mass in a rational and money-saving process.

For refractory masses there can be employed known refractory compositions for use as reaction vessel liners especially those refractory masses known for use as a liner for a metal refining reactor. Clay-bound bauxite compounds such as those containing 87% bauxite and 13% ground clay have proven particularly suitable as slinging masses. Additionally clay-bound mullite masses and clay-bound corundum masses can also be employed. These masses can contain a binding agent such as a chemical binder, as known in the art.

BRIEF DESCRIPTION OF DRAWINGS

The invention can be more readily understood and appreciated when reference is made to the accompanying drawings in which:

FIG. 1 is a side elevation showing the horizontal disposition of a tubular vessel the interior wall of which is in the process of having applied thereto a moist refractory mass. FIG. 1 can be considered to be a section taken along the line of A—A of FIG. 2;

FIG. 2 shows a device according to the invention taken along the line B—B of FIG. 1.

DESCRIPTION OF SPECIFIC EMBODIMENTS

The tubular vessel 1 of a transport ladle for pig iron is positioned on two operating devices 2 rotatably in a horizontal position for the production of the refractory lining. A bearer 3 is arranged in the inner part of the vessel parallel to the axis of the vessel. This bearer 3 is held on two supports 4 which are anchored securely near the ends of the vessel on the working floor. Both supports 4 are formed in such a manner by conveying and holding means, which are not shown, that the arrangement of the bearer 3 in the inner part of the vessel and a soluble securing to the supports 4 can be achieved.

The bearer 3 is a rectangular box beam which is vertically restrained in the supports 4.

A slinger machine 5 is arranged on the bearer 3 to be able to move backwards and forwards. This slinger machine 5 consists essentially of a slinger wheel casing 6 with slinger wheel, a slinger wheel drive motor 7 (FIG. 2) and a wheel track 8 with motor. The wheel-track 8 embraces the upper section of the bearer 3 in the form of a "U" for support and direction thereof.

The feeding of the refractory mass to the slinger machine 5 is achieved by a conveyor belt 9, which is arranged in an elongated supporting structure 10. The supporting structure 10 is connected securely at its one end to the slinger machine 5, while the other end is positioned so that it can be moved backwards and forwards on a roller track 11 (FIG. 1) arranged outside the vessel 1. The electrical lead 12 for the slinger machine 5 is hung up on the under side of the supporting structure 10 in a loop to provide slack to be taken up when the slinger machine and conveyor are at the opposed end of the vessel.

The refractory mass, which is then in a bunker or hopper 13, is transported over a discharge device 14 onto the conveyor belt 9 and is conducted from this over a short conveyor belt 15 (FIG. 2) in the slinging head 6 of the slinger machine 5. The slinger wheel slings the mass in balls in quick succession and vertically at high speed down onto the inner wall of the vessel while the slinger machine 5 is moved backwards and forwards over the length of the container.

This movement backwards and forwards is repeated until a longitudinal section of the refractory lining 16 is slung in its complete thickness. After the vessel 1 has been further rotated around the width of a longitudinal section, the next longitudinal section of the refractory lining a slung. In this way the complete refractory lining 16 of the container 1 arises successively.

The mass slung onto the inner wall of the vessel is supported on the free side of the lining section by a template 17 which is arranged on the bearer 3 and extends over the complete length of the vessel. For slinging the first longitudinal section of the refractory lining 16, the second free side is supported by a bricked longitudinal stone layer 18, which was inserted in place within the vessel prior to commencement of the slinging operation.

The vessel 1 here portrayed possesses a bricked permanent lining 19 and a stone ring 20 at the ends of the vessel in order to achieve a clean completion of the slung lining at these points. The bricks of the permanent lin-ing 19 should preferably have a grooved surface rather than the usual smooth surface for favorable adhesion of the slung mass.

A work desk 21 is provided to control all working cycles which is amongst other things equipped with a motor connected to a television camera 22 secured onto the slinging head 6 for observing the lining produced. If the liner has a roughened uneven surface, a milling machine 23 arranged adjustably on the slinger machine can be brought into operation to smooth the surface of the slung lining 16.

The elements of the device are removed from the vessel one after another after the complete lining is finished, and said vessel can be placed on to the wheel frame belonging thereto (not shown) after the lining has dried and after the locking covers, which are also lined with refractory material, have been secured.

If the refractory lining is to be produced using the alternative method according to the invention, according to which the mass tream is held in its position by rotating the vessel and is shifted around a slung annular section in the direction of the axis of said vessel, the device of the described example of operation can also be used.

It is simply necessary to present a development of the steps of the method suited to the alternative method whereby the rotation of the vessel 1 from the work desk 21 is controlled by holding the mass stream of the slinging head 6 in its position and by shifting the slinging head 6 around a slung annular section in the direction of the axis of the vessel.

According to the alternative embodiment, successive annular sections are formed instead of successive longitudinal sections. This can be done by applying the refractory mass to an annular section from the slinging machine and rotating the vessel itself one complete revolution (360 degrees) until the entire annular section has been covered by the refractory mass. The slinging machine is then moved longitudinal within the vessel for the purpose of coating a second annular section. Generally this second annular section will be adjacent the first but not necessarily. The vessel is again rotated until that second annular section is completely coated. This is repeated until all annular sections of the vessel are coated.

What is claimed is:

1. A process for the production of a refractory lining with a tubular rotatable vessel which comprises disposing said vessel so that its longitudinal axis running therethrough is horizontal, slinging a moist refractory mass onto a longitudinal section of an interior wall thereof, rotating said vessel about its horizontal axis and applying moist refractory mass parallel to said longitudinal axis onto another longitudinal section of said interior wall, said refractory mass being slung in a direction normal to the walls of the vessel, said refractory mass being a known mass as used as liner for a metal refining reactor.

2. A process according to claim 1 wherein the successive steps of applying refractory mass to a longitudinal section and rotating the vessel are conducted until the entire interior wall is covered by refractory mass.

3. A process according to claim 1 wherein said refractory mass is applied to said longitudinal section at different points along the length of said section from a common source.

4. A process according to claim 3 wherein said mass is slung onto said section while said source is moved forwards and backwards within said vessel.

5. A process according to claim 1 wherein said refractory mass is slung onto said longitudinal section until substantially the entire length thereof is covered with said refractory mass and thereafter said vessel is rotated and refractory material is applied to a second longitudinal section until substantially its entire length is covered by refractory mass.

6. A process according to claim 1 wherein refractory mass slung onto a longitudinal section is supported on its free side to be lined by a vertical template.

7. A process according to claim 1 wherein the free side of the first longitudinal section to which refractory mass is to be applied has a brick longitudinal stone layer to support the refractory muss to be applied.

8. A process for the production of a refractory lining within a rotatable vessel comprising disposing said vessel so that its longitudinal axis running therethrough is horizontal, slinging a moist refractory mass onto a first annular section of an interior wall thereof, thereafter applying moist refractory mass to a second annular section of said interior wall, said refractory mass being slung in a direction normal to the walls of the vessel, said refractory mass being a known mass as used as liner for a metal refining reactor.

9. A process according to claim 8 wherein said refractory mass is applied to said annular sections from a common source, following the application of said refractory mass to said first annular section said vessel is rotated at least 360 degrees, said common source is moved longitudinally within said vessel to face a second annular section and refractory mass is applied to said second annular section and said vessel is rotated at least 360 degrees whereby as second annular section of said vessel is coated with refractory mass.

10. A process according to claim 9 wherein the successive steps of applying refractory mass to an annular section rotating said vessel and longitudinally moving said common source are conducted until all of the annular sections of the interior wall of said vessel are covered with refractory mass.

11. A process according to claim 9 wherein said refractory mass is applied to successive annular sections along the length of said vessel from a common source.

12. A process according to claim 9 wherein said mass is slung onto said annular section while said vessel is rotated.

13. A process according to claim 9 wherein said refractory mass is slung onto said annular section until the entire inner circumference of said annular section is covered by refractory mass while said vessel is rotated at least 360 degrees, thereafter said common source is longitudinally moved to a second position within said vessel and while held at said position refractory mass is applied to a second annular section while said vessel is rotated at least 360 degrees.

14. A process according to claim 9 wherein refractory mass slung onto annular section is supported on its free side to be lined by a vertical template.

15. A process according to claim 9 wherein the free side of the first annular section to which refractory mass is to be applied has a brick annular ring to support refractory mass to be applied.

16. A process according to claim 1 wherein said refractory mass is applied to said longitudinal section by a slinger machine.

17. A process according to claim 9 wherein said refractory mass is applied to said annular section by a slinger machine.

18. A process according to claim 1 wherein said tubular vessel is provided with detachable locking covers on both sides thereof.

19. A process according to claim 1 wherein after rotation of said vessel about its horizontal axis and prior to applying moist refractory mass parallel to its longitudinal axis said tubular vessel is moved along its longitudinal axis.

20. A process according to claim 1 wherein after rotation of said vessel about its horizontal axis and prior to applying moist refractory mass parallel to its longitudinal axis the source of moist refractory mass is moved longitudinally along said longitudinal axis.

21. A process according to claim 8 wherein said vessel is provided with detachable locking covers on both sides thereof.

22. A process according to claim 8 wherein after slinging said refractory mass onto a first annular section of an interior wall and prior to applying said refractory mass to a second annular section of said interior wall said vessel is moved along its longitudinal axis.

23. A process according to claim 8 wherein after slinging said refractory mass onto a first annular section of an interior wall and prior to applying said refractory mass to a second annular section of interior wall the source of said refractory mass is moved longitudinally within said rotatable vessel.

24. A process according to claim 1 wherein said tubular rotatable vessel is a torpedo ladle.

25. A process according to claim 8 wherein said rotatable vessel is a torpedo ladle.

26. A process according to claim 5 wherein said tubular rotatable vessel is a torpedo ladle.

* * * * *